United States Patent [19]

Vallance et al.

[11] 4,156,639

[45] May 29, 1979

[54] DIAPHRAGM CELLS

[75] Inventors: Christopher Vallance; Peter J. Davies, both of Runcorn, England

[73] Assignee: Imperial Chemical Industries, Limited, London, England

[21] Appl. No.: 888,386

[22] Filed: Mar. 20, 1978

[30] Foreign Application Priority Data

Apr. 13, 1977 [GB] United Kingdom ..... 15279/77

[51] Int. Cl.[2] ..... C25B 9/00; C25B 13/02; C25B 13/08

[52] U.S. Cl. ..... 204/252; 204/296; 204/266

[58] Field of Search ..... 204/252–254, 204/255–258, 263–266, 296

[56] References Cited

U.S. PATENT DOCUMENTS

| | | | |
|---|---|---|---|
| 3,923,630 | 12/1975 | Argade et al. | 204/252 X |
| 4,003,818 | 1/1977 | Juillard et al. | 204/296 |
| 4,031,041 | 6/1977 | Bouy et al. | 204/252 X |
| 4,065,534 | 12/1977 | Rechlicz et al. | 204/296 X |
| 4,081,350 | 3/1978 | Kadija et al. | 204/296 |

FOREIGN PATENT DOCUMENTS

| | | | |
|---|---|---|---|
| 143171 | 3/1949 | Australia | 204/296 |
| 7601342 | 8/1976 | Netherlands | 204/296 |

*Primary Examiner*—John H. Mack
*Assistant Examiner*—D. R. Valentine
*Attorney, Agent, or Firm*—Cushman, Darby & Cushman

[57] ABSTRACT

An electrolytic diaphragm cell for the production of halogen, hydrogen and an alkali metal hydroxide solution by electrolysis of an aqueous alkali metal halide solution, the cell comprising a plurality of anodes vertically mounted on the base of the cell, a cathode box providing cathodes between adjacent anodes, and a hydraulically permeable diaphragm between adjacent anodes and cathodes comprising one or more sheets of a porous non-melt-processable fluorine-containing polymer joined into the form of an endless-belt by a strip or strips of melt-processable fluorine-containing polymer fused into the sheet or sheets at or near juxtaposed edges of the sheet or sheets, the diaphragms being connected to upper and lower slotted supports of a melt-processable fluorine-containing polymer by means of strips of a melt-processable fluorine-containing polymer bonded to the supports at or near the slots therein and fused to the upper and lower edges of the diaphragm.

6 Claims, 5 Drawing Figures

DIAPHRAGM CELLS

This invention relates to electrolytic diaphragm cells and to the use of porous diaphragms in electrochemical cells.

Porous diaphragms based on tetrafluoroethylene polymers are especially suitable for use in cells electrolysing alkali metal chloride solutions. Unfortunately, however, there are problems associated with the development of the use of such diaphragms in electrolytic cells. For example, there is generally a limit on the dimensions of the diaphragm sheets that can be produced in practice. Of necessity the width of the diphragm sheet is governed by the size of the rolls employed in producing the sheet. The cost of increasing the size of the manufacturing equipment is exponential with the result that there is an optimum size of roll which is dependent upon purely commercial factors. Moreover, diaphragms of simple rectangular sheet form are extremely difficult to fit on to the complicated cathode designs of modern diaphragm cells because of the numerous recesses and protruberances presented by the cathode. The aforesaid problems are accentuated in the case of diaphragms made of non-melt-processable materials such as polytetrafluoroethylene. The main reason for this is that it is extremely difficult to join together small sheets of polytetrafluoroethylene in order to produce a diaphragm of the desired complex shape and size.

In the specification of our U.K. Patent Application No. 28804/74 (Belgian Pat. No. 830739) we have described a method of manufacturing a porous diaphragm for an electrolytic cell from a plurality of sheets of filled polytetrafluoroethylene which method comprises fusing a melt-processable fluorine-containing polymer into said sheets at or near juxtaposed edges of said sheets at a temperature which will not substantially decompose the filler in said sheets, solidifying the melt-processable polymer so as to effect joining of the sheets, and thereafter removing filler from the thus joined sheets to produce a porous sheet.

By the term "filled polytetrafluoroethylene sheet" we mean polytetrafluoroethylene sheet containing a removable solid particulate additive (e.g. starch) which may be removed from the sheet in order to impart porosity to the sheet. The resultant porous sheet may then be used as a diaphragm in an electrolytic cell.

By melt-processable fluorine-containing polymer we mean a fluorine-containing polymer which may be fused by the application of heat and which returns to its original form on removal of heat and also retains its original properties.

In one embodiment of the invention described in the aforesaid specification two or more sheets of filled polytetrafluoroethylene are joined along juxtaposed edges by overlapping the edges with one or more strips of melt-processable fluorine-containing polymer and fusing the strip or strips into the areas of the sheets adjacent to the juxtaposed edges.

However, in a preferred embodiment of the aforesaid invention one or more strips of melt-processable fluorine-containing polymer can be made to partially overlap one or more edges of a sheet of filled polytetrafluoroethylene and protruding portions of the strip or strips can be utilised as desired to bond the polytetrafluoroethylene sheet to other polytetrafluoroethylene sheets which have not had melt-processable strips of fluorine-containing polymer fused thereto. Conveniently all four sides of a rectangular sheet of filled polytetrafluoroethylene can be provided with overlapping strips of melt-processable fluorine-containing polymer to give a window-frame of melt-processable polymer which can be joined to other filled polytetrafluoroethylene sheets by conventional plastics fabrication techniques.

In U.S. Pat. No. 3923630 there is described an electrolytic diaphragm cell for the production of chlorine and caustic soda from aqueous alkali metal chloride solution comprising a plurality of anodes mounted at the bottom of the cell, a cathode between adjacent anodes and a diaphragm spaced between each cathode and anode, thereby dividing the cell into anolyte and catholyte compartments, and porous material in the form of an endless belt which extends between and is connected to upper and lower supports. The upper and lower supports are provided with openings which in the cell are in alignment with one another, the anodes extend through the openings of the lower support, and each cathode is encased within the upper support, the diaphragm and the lower support. The diaphragm and diaphragm supports are preferably made of tetrafluoroethylene polymers or copolymers. There is no indication given in the aforesaid patent of how the endless belt diaphragm is fabricated. The endless belt may be attached to the supports, for example, by heat-sealing. Heat sealing would be unsatisfactory, however, for the fabrication of endless belt diaphragms from a sheet and for attaching the diaphragm to the supports when the diaphragm and the support are comprised of polytetrafluoroethylene since, although polytetrafluoroethylene fuses when heat is applied, it also decomposes within a few degrees of its melting point. Moreover, the melt viscosity of polytetrafluoroethylene is too high for the application of conventional heat-sealing plastics fabrication techniques, and in fact, polytetrafluoroethylene may be considered as a non-melt-processable material as compared with the melt-processable materials referred to in the above U.K. Patent Application No. 28804/74.

We have now found that the method of joining polytetrafluoroethylene sheets as described in the aforesaid U.K. Patent Application No. 28804/74 may be adapted for fabricating endless belt fluoropolymer diaphragms and we have further discovered an improved method of supporting the aforesaid endless belt diaphragms in an electrolytic cell.

According to the present invention we provide an electrolytic diaphragm cell for the production of halogen, hydrogen and an alkali metal hydroxide solution by electrolysis of an aqueous alkali metal halide solution, which cell comprises a plurality of anodes vertically mounted on the base of the cell, a cathode box providing a cathode between adjacent anodes, and a hydraulically permeable diaphragm between adjacent anodes and cathodes, wherein the diaphragms comprise one or more sheets of a porous non-melt-processable fluorine-containing polymer joined into the form of an endless belt by a strip or strips of melt-processable fluorine-containing polymer fused into the sheet or sheets at or near juxtaposed edges of the sheet or sheets, the diaphragms being connected to upper and lower slotted supports of a melt-processable fluorine-containing polymer by means of strips of a melt-processable fluorine-containing polymer bonded to the supports at or near the slots therein and fused to the upper and lower edges of the diaphragm, and wherein the supports are located in the cell so that the slots in the upper and lower supports are in vertical alignment with one another and the anodes extend through the slots of the lower support and into the spaces defined by the endless belt diaphragms.

The non-melt-processable fluorine-containing polymer comprising the diaphragm may be polyvinylidene fluoride, for example, but the preferred polymer is polytetrafluoroethylene.

The sheets of fluorine-containing polymer constituting the diaphragm may be of filled polytetrafluoroethylene (i.e. polytetrafluoroethylene containing a removable filler such as starch).

The filled sheets may be prepared from aqueous dispersions of polytetrafluoroethylene and removal filler by the methods described in our U.K. Pat. Nos. 1081046 and 1424804. The filler may be removed prior to introducing the diaphragm into the cell, for example by treatment with acid to dissolve the filler: Alternatively the filler may be removed from the diaphragm in situ in the cell, for example as described in the specification of our U.K. Pat. No. 1468355 in which either acid containing a corrosion inhibitor is used to dissolve the filler or the filler is removed electrolytically.

Alternatively, the diaphragm may be formed from sheets of porous polymeric material containing units derived from tetrafluoroethylene, said material having a microstructure characterised by nodes interconnected by fibrils. The aforesaid polymeric material and its preparation are described in U.K. Pat. No. 1355373, and its use as a diaphragm in electrochemical cells is described in our copending cognate U.K. Patent Application Nos. 23275/74 and 23316/74 (Belgian Pat. No. 829388).

The sheets constituting the diaphragm may also be formed by an electrostatic spinning process. Such a process is described in our copending U.K. Patent Application No. 41873/74 (Belgian Pat. No. 833912) and involves introducing a spinning liquid comprising an organic fibre-forming polymeric material (e.g. a fluorine-containing polymer such as poly-tetrafluoroethylene) into an electric field whereby fibres are drawn from the liquid to an electrode and collecting the fibres so produced upon the electrode in the form of a porous sheet.

The porous diaphragm may contain a non-removable filler such as titanium dioxide in order to render the diaphragm wettable when installed in an electrolytic cell.

The endless belt diaphragm may be fabricated from one or more sheets of non-melt-processable fluorine-containing polymer (especially polytetrafluoroethylene), each sheet being provided with strips of melt-processable fluorine containing polymer fused into the sheet at or near at least three edges of the sheet two of which correspond to the upper and lower edges of the diaphragm when in the cell. If only one sheet is used to form the endless-belt diaphragm, the sheet may be provided with a pair of strips fused at or near the edges corresponding to the upper and lower edges of the diaphragm when in the cell and with a strip fused at or near one or preferably both of the other two edges. The diaphragm may then be formed by folding the sheet into an endless belt and joining either one strip to the sheet or preferably two strips to each other, using conventional plastics fabrication techniques such as hot-pressing or by the use of a suitable cement (e.g. a low melting point fluorine-containing polymer). The strips of fluorine-containing polymer fused to the endless-belt diaphragm at or near the upper and lower edges of the diaphragm may then be joined respectively to the inside edges of the slots (discussed below) of the upper and lower supports of melt-processable fluorine-containing polymer, for example by use of conventional hot-pressing techniques or the application of a suitable cement (for example a low melting point fluorine-containing polymer).

The supports are preferably fabricated from a flexible sheet of melt-processable fluorine-containing polymer from which slots can be pressed out by any conventional method (e.g. by vacuum-pressing. The supports are conveniently formed with folds along the inside edges of the slots to facilitate connection between the supports and the strips of melt-processable fluorine-containing polymer fused to the upper and lower edges of the diaphragm.

The melt-processable fluorine-containing polymer in the production of the diaphragm and used for fabricating the upper and lower slotted supports is preferably selected from polychlorotrifluoroethylene, polyvinylidene fluoride, fluorinated ethylene/propylene copolymer, a copolymer of tetrafluoroethylene and polyperfluoroalkoxy compounds, or a copolymer of ethylene and chlorotrifluoroethylene. It is especially preferred to use a fluorinated ethylene/propylene copolymer as the melt-processable fluorine-containing polymer.

The anodes preferably comprise film-forming metal plates carrying on at least part of their surface an electrocatalytically active coating.

In this specification, by a 'film-forming' we mean one of the metals titanium, zirconium, niobium, tantalum or tungsten or an alloy consisting principally of one of these metals and having anodic polarisation properties which are comparable to those of the pure metal. It is preferred to use titanium alone, or an alloy based on titanium and having polarisation properties comparable to those of titanium, as the film-forming metal constituting the anode plate. Examples of such alloys are titanium-zirconium alloys containing up to 14% of zirconium, alloys of titanium with up to 5% of a platinum group metal such as platinum, rhodium or iridium and alloys of titanium with niobium or tantalum containing up to 10% of the alloying constituent.

The anodes are mounted on the base comprising a metal baseplate, preferably of a film-forming metal such as titanium, and the baseplate is in turn conductively bonded to a suitable conductor or conductors, for example a mild steel slab which serves as a conductor providing a low-resistance electrical flow path between the anodes and copper conductors attached to the mild steel slab.

The electrocatalytically active coating is a conductive coating which is resistant to electrochemical attack and which is active in transferring electrons between electrolyte and the anode.

The electrocatalytically active material may suitably consist of one or more platinum group metals, i.e. platinum, rhodium, iridium, ruthenium, osmium and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chlorine discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron, cobalt, nickel and mixtures thereof.

Especially suitable electrocatalytically active coatings include platinum itself and those based on ruthenium dioxide/titanium dioxide and ruthenium dioxide/-tin dioxide/titanium dioxide.

Other suitable coatings include those described in our U.K. Pat. Nos. 1402414 and 1484015 in which a non-conducting particulate or fibrous refractory material is embedded in a matrix of electrocatalytically active material (of the type described above). Suitable non-conducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgOAl_2O_3$) aluminosilicates (e.g. mullite $(Al_2O_3)(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anodes may be prepared by a painting and firing technique, wherein a coating of metal and/or metal oxide is formed on the anode surface by applying a layer of a paint composition comprising thermally-decomposable compounds of each of the metals that are to feature in the finished coating in a liquid vehicle to the surface of the anode, and then firing the paint layer by heating the coated anode, suitably at 250° C. to 800° C., to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied on to a layer of the aforesaid paint composition while this is still in the fluid state on the surface of the anode, the paint layer then being dried by evaporation of the liquid vehicle and fired in the usual manner.

The electrode coatings are preferably built up by applying a plurality of paint layers on the anode, each layer being dried and fired before applying the next layer.

The cathodes are preferably comprised of mild steel or iron mesh, and are mounted in the cathode box which is typically of mild steel. The cathode box is provided with openings through which the anodes pass. The cathode box is suitably provided with a current-outlet lead, an outlet for alkali metal hydroxide solution and an outlet for hydrogen.

The cell is suitably provided with a lid, for example of mild steel, carrying an inlet for aqueous alkali metal halide solution and an outlet for halogen.

The invention is especially applicable to diaphragm cells used for the manufacture of chlorine and caustic soda by the electrolysis of aqueous sodium chloride solutions.

By way of example, embodiments of the present invention will not be described with reference to the accompanying drawings in which FIG. 1 is a plan schematic view of a "window-frame" sheet.

Figure 1:
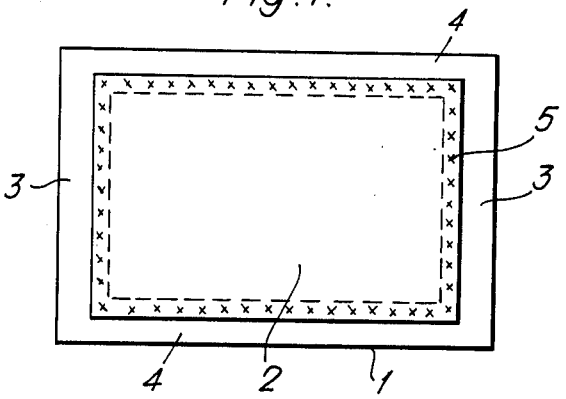

Referring initially to FIG. 1, the "window-frame" sheet 1 comprises a rectangular sheet 2 of a non-melt-processable fluorine-containing polymer, for example polytetrafluoroethylene, which is either porous or contains a removable filler (for example starch) which is subsequently removed to provide the desired porosity. The sheet 2 is provided with strips 3, 4 of a melt-processable fluorine-containing polymer, for example a fluorinated ethylene/propylene copolymer, which have been fused into the sheet 1, for example by hot-pressing, to give overlapping joints 5.

Figure 2:
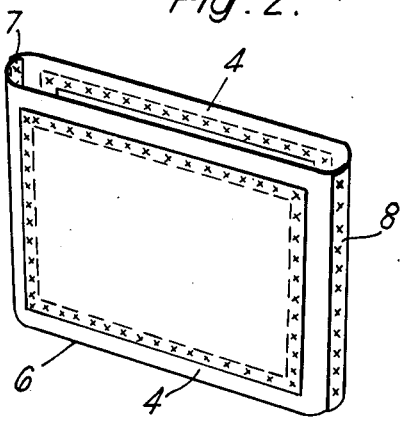
FIG. 2 is a perspective schematic view of an endless-belt diaphragm comprising two "window-frame" sheets.

The endless-belt diaphragm 6 shown in FIG. 2 comprises two "window-frame" sheets 1. It is formed by joining two pairs of strips 3 to give overlapping joints at 7, 8, for example by hot-pressing to give welded joints or by the application of a suitable cement (e.g. a low molecular weight, low melting point, polytetrafluoroethylene). The endless-belt diaphragm 6 thus obtained has strips 4 of a melt-processable fluorine-containing polymer along its upper and lower edges.

Figure 3:
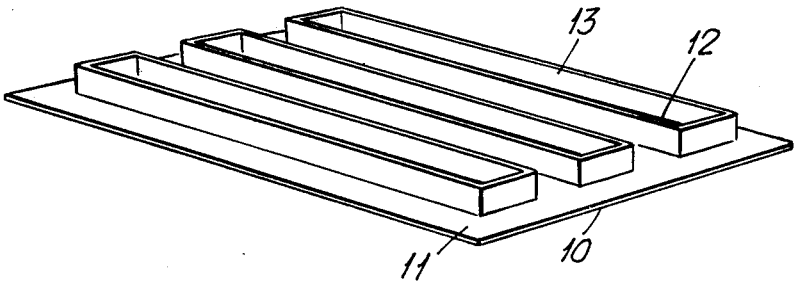
FIG. 3 is a perspective view of a support.

The upper and lower supports 9, 10 (both shown in FIG. 5; the upper support 10 shown in FIG. 3), which are identical in shape, each comprises a sheet 11 provided with slots 12 formed by folding sections of the sheet to provide edges 13 along the perimeter of the slots 12. When installed in a cell (FIG. 5), the upper and lower supports 9, 10 have their edges 13 facing upwardly and downwardly respectively relative to sheet 11. The supports 9, 10 are comprised of a melt-processable fluorine-containing polymer, for example a fluorinated ethylene/propylene copolymer, and are conveniently formed from a sheet of the aforesaid fluorine-containing polymer, for example by vacuum pressing.

Figure 4:
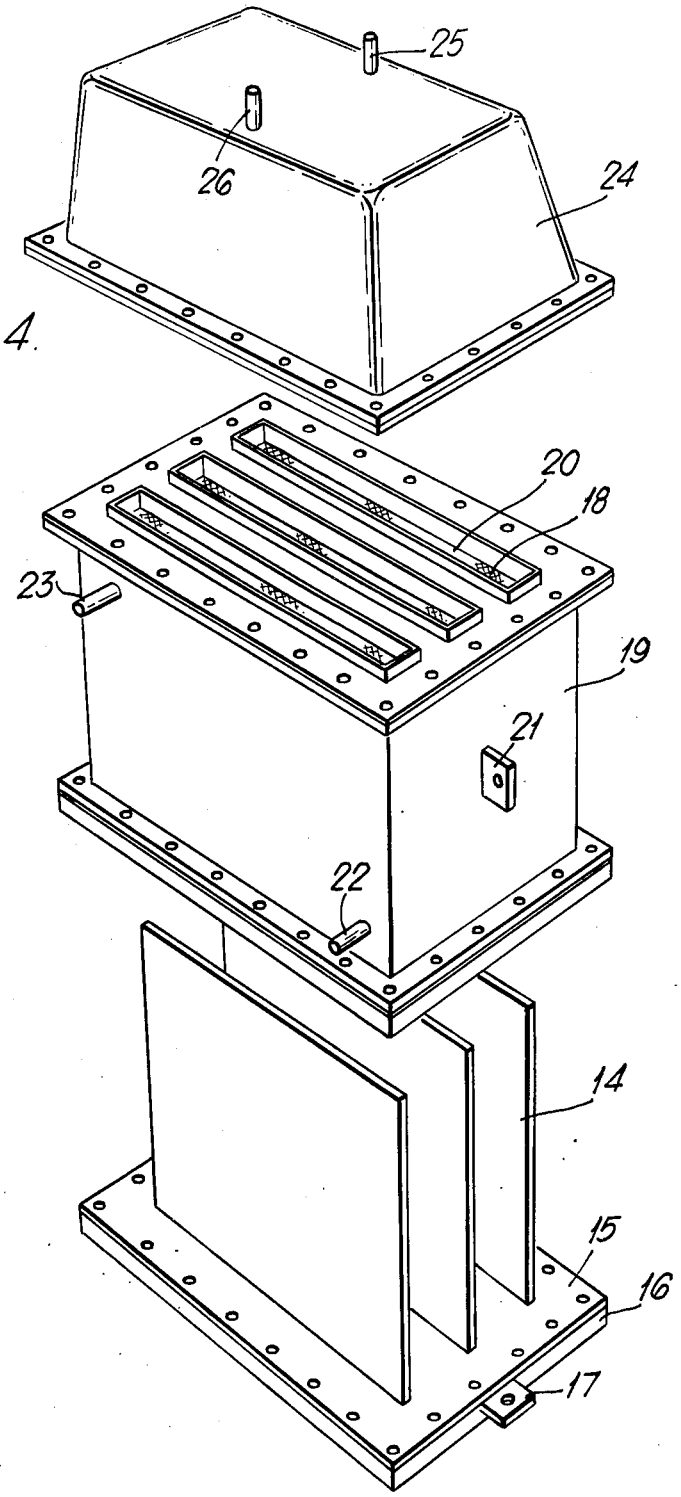
FIG. 4 is a perspective expanded view of a diaphragm cell incorporating the endless-belt diaphragm of FIG. 2.

The diaphragm cell into which the diaphragm 6 and the supports 9, 10 are to be assembled is shown in FIG. 4.

Each anode 14 is typically a vertical plate of a film-forming metal, such as titanium, and is provided with an electrocatalytically-active coating (for example a mixture of a platinum group metal oxide and a film-forming metal oxide, especially a mixture of ruthenium oxide and titanium dioxide). The anode 14 is mounted on a baseplate 15, suitably of a film-forming metal such as titanium, and the baseplate 15 is in turn conductively bonded to a mild steel slab 16 which serves as a conductor providing a low-resistance electrical flow path between the anodes 14 and copper connectors 17 attached to a side edge of the mild steel slab 16.

The cathodes 18, which are typically of mild steel or iron mesh, are mounted in a box-like structure 19, typically of mild steel, which is provided with openings 20 through which the anodes 14 pass. The cathode box-like structure 19 is further provided with a current-outlet lead 21 attached thereto an outlet conduit 22 for alkali metal hydroxide solution and an outlet conduit 23 for hydrogen.

The cell is provided with a lid 24 carrying an inlet conduit 25 for alkali metal halide solution and an outlet conduit 26 for halogen.

Figure 5:
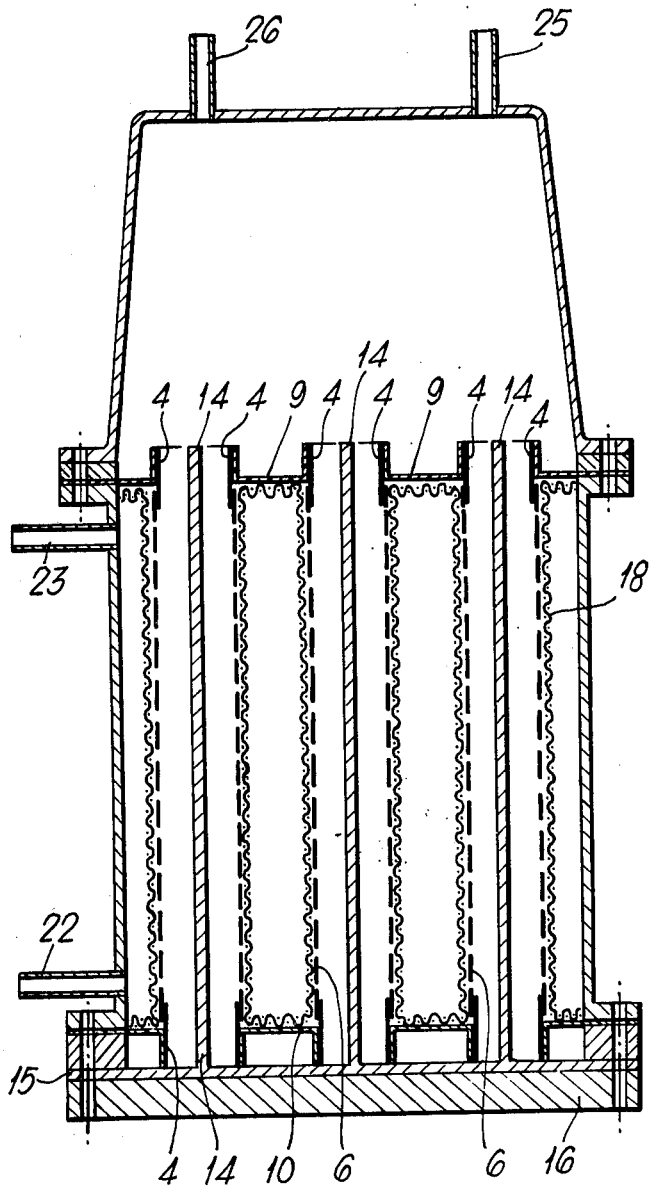
FIG. 5 is a cross-sectional schematic view of the diaphragm cell of FIG. 4 and further incorporating the supports of FIG. 3.

Referring to FIG. 5, the endless-belt diaphragms 6 surround the anodes 14 and are in contact or in close proximity to the surface of the cathodes 18. Each diaphragm 6 is attached to the upper and lower supports 9, 10 by joining strips 4 of diaphragms 6 to edges 13 of supports 9, 10, for example by hot-pressing or by the application of a suitable cement, as described above. The joining of the diaphragms 6 and supports 9, 10 is conveniently achieved outside the cell by inserting the diaphragms 6 into an empty cathode box 19, joining the top edges of each diaphragm 6 to the upper support 9, followed by turning the cathode box 19 upside down, and joining the other edge (bottom edge in the cell) to the lower support 10. The cathode box 19, containing diaphragms 6 and supports 9, 10, is then lowered over the anodes 14 and the cell is assembled. If the diaphragms 6 contain removable fillers (e.g. starch), these may be removed in situ in the cell by treatment with a mineral acid containing a corrosion inhibitor or by removing electrolytically in situ in the cell (as described in the specification of U.K. Pat. No. 1468355).

The use of the cell according to the invention is illustrated by the following Example:

EXAMPLE

A diaphragm cell of the type shown in FIGS. 4 and 5 was provided with 3 sets of titanium flat anode plates 14 (each 2.5 mm thickness) coated with a mixture of ruthenium oxide and titanium dioxide, and mounted on a titanium baseplate 15. The anode plates 14 were fitted into the openings 20 of a cathode box 19 provided with mild steel mesh cathodes 18 (2 mm diameter mesh; 2 mm×2 mm opening). The cell was provided with an endless loop diaphragm 6 of polytetrafluoroethylene which was in contact with the cathodes 18. The diaphragm was fabricated by joining together two "window frame" sheets 1 by hot pressing overlapping strips of a fluorinated ethylene propylene copolymer fused at or near the edges of a starch-filled polytetrafluoroethylene sheet (2 mm thickness). The diaphragm 6 was in turn attached to the upper and lower supports 9, 10 made of a fluorinated ethylene/propylene copolymer by hot pressing strips of fluorinated ethylene/propylene (previously fused to the upper and lower edges of the diaphragm) to the said supports. The anode cathode gap was 13 mm. The starch was extracted from the diaphragm electrolytically in situ in the cell at a current density of 2 kA/m$^2$ anode surface.

The cell was fed with sodium chloride brine (300 g/liter NaCl) at a rate of 5 liters/hour, and the cell was at a current density of 2 kA/m$^2$. The cell operating voltage was 3.2 volts. The chlorine produced contained 97% by weight of $Cl_2$ and 3% by weight of $O_2$. The sodium hydroxide produced contained 10% by weight of NaOH. The cell operated at a current efficiency of 96%.

What we claim is:

1. An electrolytic diaphragm cell for the production of halogen, hydrogen and an alkali metal hydroxide solution by electrolysis of an aqueous alkali metal halide solution which cell comprises a plurality of anodes vertically mounted on the base of the cell, a cathode box providing a cathode between adjacent anodes, and a hydraulically permeable diaphragm between adjacent anodes and cathodes, wherein the diaphragms comprise one or more sheets of a porous non-melt-processable fluorine-containing polymer joined into the form of an endless-belt by a strip or strips of melt-processable fluorine-containing polymer fused into the sheet or sheets at or near juxtaposed edges of the sheet or sheets, the diaphragms being connected to upper and lower slotted supports of a melt-processable fluorine-containing polymer by means of strips of a melt-processable fluorine-containing polymer bonded to the supports at or near the slots therein and fused to the upper and lower edges of the diaphragm, and wherein the supports are located in the cell so that the slots in the upper and lower supports are in vertical alignment with one another and the anodes extend through the slots of the lower support and into the spaces defined by the endless-belt diaphragms.

2. A cell as claimed in claim 1 wherein the joining of the sheet or sheets to form the endless-belt diaphragm is carried out by means of hot pressing or by the use of a cement comprising a low melting point fluorine-containing polymer.

3. A cell as claimed in claim 1 or claim 2 wherein the upper and lower slotted supports are formed with folds along the inside edges of the slots to facilitate connection between the supports and the strips of melt-processable fluorine-containing polymer fused to the upper and lower edges of the diaphragm.

4. A cell as claimed in claim 1 wherein the diaphragm is joined to the upper and lower slotted supports by means of hot pressing or by the use of a cement comprising a low melting point fluorine-containing polymer.

5. A cell as claimed in claim 1 wherein the non-melt-processable fluorine-containing polymer is polytetrafluoroethylene.

6. A cell as claimed in claim 1 wherein the melt-processable polymer is a fluorinated ethylene/propylene copolymer.

* * * * *